US007001486B2

(12) United States Patent
Hilger

(10) Patent No.: US 7,001,486 B2
(45) Date of Patent: Feb. 21, 2006

(54) VACUUM DEVICE FOR PAPER WEB MAKING APPARATUS

(75) Inventor: Sheldon John Hilger, Cumming, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/326,026

(22) Filed: Dec. 19, 2002

(65) Prior Publication Data

US 2004/0118543 A1 Jun. 24, 2004

(51) Int. Cl.
*D21F 1/32* (2006.01)

(52) U.S. Cl. ..... 162/278; 162/252; 162/306; 162/361; 162/363; 162/279; 226/97.4

(58) Field of Classification Search ..... 162/252, 162/278, 306, 361, 363; 226/97.4
See application file for complete search history.

(56) References Cited

U.S. PATENT DOCUMENTS 3,301,746 A 1/1967 Sanford et al.
4,016,628 A 4/1977 Kolbach
4,406,739 A 9/1983 Kankaanpää
4,547,266 A * 10/1985 Keller et al. ..... 162/252
4,637,859 A 1/1987 Trokhan
4,714,523 A 12/1987 Sawyer, Jr. et al.
4,880,500 A 11/1989 Eldridge et al.
5,048,589 A 9/1991 Cook et al.
5,429,686 A 7/1995 Chiu et al.
5,744,007 A 4/1998 Trokhan et al.
5,830,321 A * 11/1998 Lindsay et al. ..... 162/204
6,080,279 A 6/2000 Hada et al.
6,126,788 A 10/2000 Schiel
6,306,257 B1 10/2001 Hada et al.
6,306,258 B1 10/2001 Lange et al.
6,447,641 B1 9/2002 Wolkowicz et al.

OTHER PUBLICATIONS

International Search Report for PCT/US 03/22202 dated Nov. 10, 2003, 4 pages.

* cited by examiner

*Primary Examiner*—Mark Halpern
(74) *Attorney, Agent, or Firm*—Senniger Powers

(57) ABSTRACT

A vacuum device for a paper web making apparatus has a housing having an outer web-facing surface and a vacuum channel extending within the housing and having an opening at the web-facing surface. A vacuum source is in fluid communication with the vacuum channel and is operable to draw a vacuum on the paper web via the vacuum channel opening. A fluid delivery system is operable to deliver cleaning fluid into the vacuum channel wherein the vacuum source is operable during the delivery of cleaning fluid into the vacuum channel. In another embodiment, the fluid delivery system is operable to deliver cleaning fluid into the vacuum channel in a fluid delivery direction that is at least partially different from the direction of flow of the vacuum within the vacuum channel.

40 Claims, 3 Drawing Sheets

VACUUM DEVICE FOR PAPER WEB MAKING APPARATUS

BACKGROUND OF THE INVENTION

This invention relates generally to apparatus and methods for making paper webs, such as webs for making facial tissue, bath tissue, paper towels, wipes, napkins and the like, and more particularly to apparatus and methods for applying a vacuum to the paper web during the making of such webs.

In conventional apparatus for making paper webs, a paper stock is fed onto endless foraminous belts or "fabrics" which are driven and supported by suitable drive rolls and tensioning rolls. The moving fabrics thereby serve as the surfaces on which the paper webs are formed while being transported in a machine direction by the apparatus. Typically, an aqueous suspension of papermaking fibers is delivered onto a first, or "forming" fabric to form a wet web which is then carried downstream past one or more vacuum devices, also commonly referred to as vacuum boxes. The vacuum devices apply a vacuum to the forming fabric and the wet fibers supported by the fabric to facilitate dewatering of the wet web. Additional dewatering may be accomplished by supplemental noncompressive dewatering techniques, such as infra-red drying, microwave drying, sonic drying, throughdrying, superheated or saturated steam dewatering, supercritical fluid dewatering and/or displacement dewatering.

The wet web is then transferred from the forming fabric onto another fabric, or "transfer fabric," with the assistance of another vacuum device. For example, to transfer the web from one fabric to another, the transfer fabric is moved in opposed relationship with the forming fabric and passed over the vacuum device. The forming fabric, supporting the wet web in opposed relationship with the transfer fabric, converges with the forming fabric at the vacuum device whereby the vacuum device draws the wet web from the forming fabric onto the transfer fabric. The fabrics diverge from each other downstream of the vacuum device, leaving the wet web supported by the transfer fabric. Various apparatus and methods have been proposed that assist or facilitate the transfer of a paper web from a first fabric to a second fabric. For instance, U.S. Pat. No. 5,830,321 to Lindsay et al., which is incorporated herein by reference, discloses a method for improving the rush transfer of a wet paper web between two separate fabrics. The wet web is then carried downstream by the transfer fabric for additional processing in a conventional manner to form the desired end product. For example, U.S. Pat. No. 6,306,257, the entire disclosure of which is incorporated herein by reference, discloses one manner in which the web may be further processed following such a transfer.

The vacuum device used in the conventional paper making apparatus typically comprises a housing having a web-facing surface over which the wet web is transported by the fabrics, and a vacuum channel formed within the housing and open to the web-facing surface. A source of vacuum is in fluid communication with the vacuum channel to apply a vacuum to the wet web as the web passes over the web-facing surface (e.g., air is drawn into the vacuum channel at the web-facing surface). One drawback associated with the use of such a vacuum device for drawing a vacuum on a wet paper web is that the vacuum device often draws wet fibrous material from the web into the vacuum channel. The wet fibrous material has a tendency to adhere to the walls of the vacuum channel. Build-up of the wet fibrous material within the vacuum channel results in a decrease or loss of vacuum pressure. This requires the machine to be periodically shut down and the vacuum channels cleaned out.

SUMMARY OF THE INVENTION

In general, one embodiment of a vacuum device for a paper web making apparatus generally comprises a housing having an outer web-facing surface and a vacuum channel extending within the housing and having an opening at the web-facing surface. A vacuum source is in fluid communication with the vacuum channel and is operable to draw a vacuum on the paper web via the vacuum channel opening. A fluid delivery system is operable to deliver cleaning fluid into the vacuum channel wherein the vacuum source is operable during the delivery of cleaning fluid into the vacuum channel.

In another embodiment, the vacuum device generally comprises -a housing having an outer web-facing surface and a vacuum channel extending within the housing and having an opening at the web-facing surface. A vacuum source is in fluid communication with the vacuum channel for drawing air into the vacuum channel via the vacuum channel opening at the web-facing surface of the housing and for directing the air to flow through the vacuum channel in a vacuum flow direction. A fluid delivery system is operable to deliver cleaning fluid into the vacuum channel in a fluid delivery direction at least partially different from the vacuum flow direction.

In yet another embodiment, the vacuum device generally comprises a housing having an outer web-facing surface and an inner channel wall defining a vacuum channel extending within the housing. The inner channel wall has an outer end at the web facing surface and an inner end. The vacuum channel has an opening at the web-facing surface. A vacuum source is in fluid communication with the vacuum channel and is operable to draw air into the vacuum channel via the vacuum channel opening at the web-facing surface of the housing and directing the air to flow through the vacuum channel in a vacuum flow direction. A fluid delivery system is operable to deliver cleaning fluid into the vacuum channel and comprises at least one orifice in the channel wall intermediate the outer and inner ends thereof. The orifice is in fluid communication with a source of cleaning fluid whereby cleaning fluid is delivered by the fluid delivery system into the vacuum channel via said at least one orifice.

In general, one embodiment of apparatus for making a paper web comprises at least one endless fabric supporting the paper web wherein the endless fabric is moveable in a machine direction of the apparatus to transport the paper web in the machine direction. A vacuum device of the apparatus comprises a housing having a web-facing surface whereby the paper web supported by the fabric is transported past the web-facing surface of the vacuum device upon movement of the fabric in the machine direction. A vacuum channel of the device extends within the housing and has an opening at the web-facing surface. A vacuum source is in fluid communication with the vacuum channel and is operable to draw a vacuum on the paper web via the vacuum channel opening. A fluid delivery system is operable to deliver cleaning fluid into the vacuum channel during operation of the vacuum source.

In general, a method of applying a vacuum to a paper web during movement of the web in a predetermined direction generally comprises moving the paper web in the predetermined direction past a vacuum device. The vacuum device comprises a housing having a web-facing surface which generally faces the paper web upon movement of the paper web past the vacuum device. A vacuum channel extends within the housing and has an opening at the web-facing surface. A vacuum is drawn on the paper web by drawing air into the vacuum channel via the vacuum channel opening and directing the air through the vacuum channel in a vacuum flow direction. A cleaning fluid is delivered into the vacuum channel during the step of drawing a vacuum on the paper web to thereby inhibit fibrous material from the paper web against adhering to the housing within the vacuum channel.

BRIEF DESCRIPTION OF THE DRAWINGS

Corresponding reference characters indicate corresponding parts throughout the drawings.

DETAILED DESCRIPTION OF THE PREFERRED EMBODIMENTS

Figure 1:
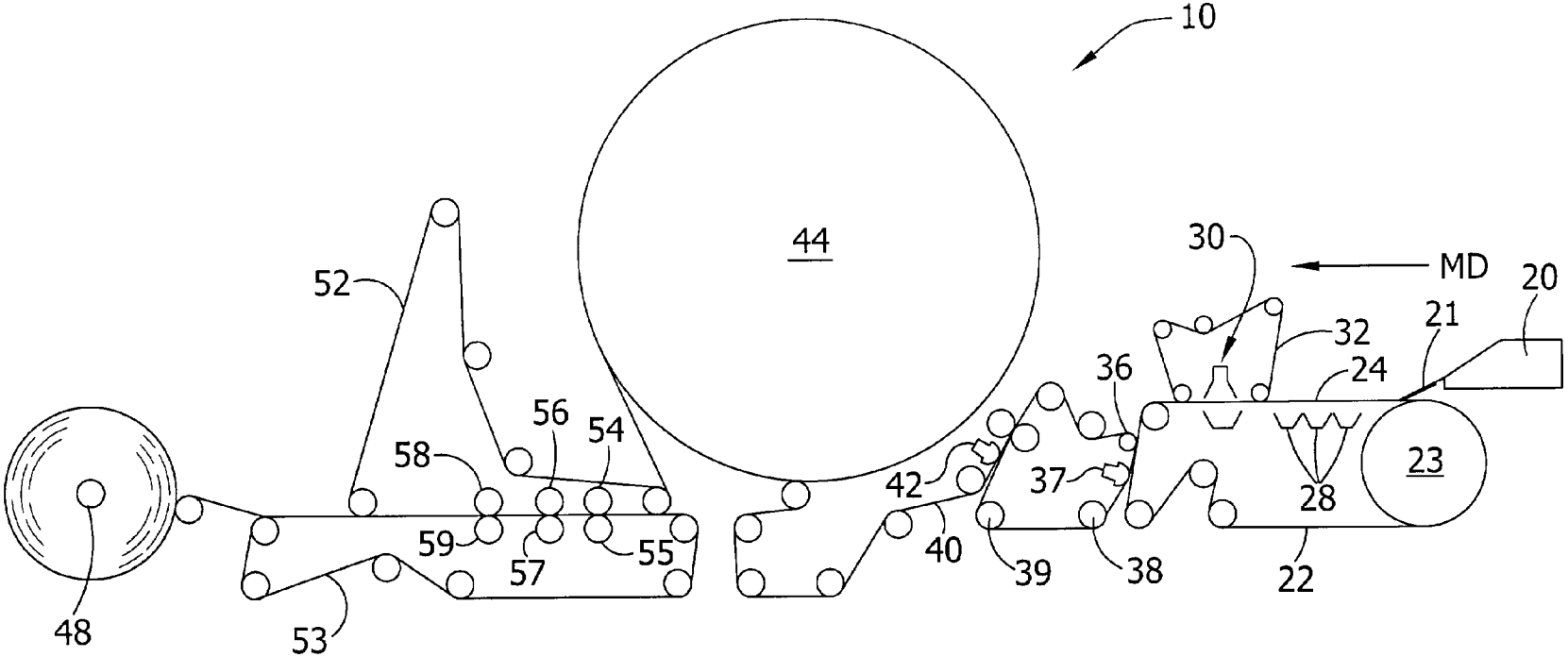
FIG. 1 is a schematic view of one embodiment of apparatus for making paper webs.

With reference now to the drawings, and in particular to FIG. 1, the present invention is illustrated and described herein with reference to a paper web making apparatus, generally indicated at 10, particularly for making a tissue product such as a facial tissue or bath tissue. However, it is understood that the present invention is applicable to any paper making apparatus in which a paper web is subjected to a vacuum during the making of such a web. For example, the paper making apparatus may be used to make other products such as paper towels, wipes, napkins and the like. Such products can be single-ply products or multi-ply products, such as two-ply, three-ply, four-ply or greater. The paper webs can be layered or unlayered (blended), and the fibers making up the web can be any fibers suitable for paper making.

In the illustrated embodiment of FIG. 1, the various tensioning rolls shown schematically, as being used to support the several fabric runs are shown but not numbered. A paper making headbox 20 injects or deposits an aqueous suspension of paper making fibers 21 onto an endless, foraminous forming fabric 22 traveling about a forming roll 23 to form a continuous, wet paper web 24 on the forming fabric 22. The forming fabric 22 supports the wet paper web 24 and carries the web downstream from the headbox 20 in a machine direction MD, and is sufficiently porous to facilitate partial dewatering of the newly formed paper web 24. The term "machine direction" MD as used herein refers to that direction in which the paper web is transported by the apparatus. A "cross-machine direction" CD is perpendicular to the machine direction and lies generally in the plane of the forming fabric 22.

The forming fabric 22 carries the wet paper web 24 to one or more vacuum devices 28, which are operable to apply a vacuum to the wet paper web to facilitate additional dewatering of the wet paper web 24 while the web is supported by the forming fabric 22. Enhanced dewatering of the wet paper web 24 is thereafter provided by suitable conventional noncompressive dewatering techniques, such as air pressing, infra-red drying, microwave drying, sonic drying, through-drying, superheated or saturated steam dewatering, supercritical fluid dewatering, and displacement dewatering. In the illustrated embodiment, the enhanced dewatering is provided by an air press, generally indicated at 30, disposed downstream of the vacuum devices 28.

In the illustrated embodiment, a support fabric 32 is brought into contact with the wet paper web 24 in advance of the air press 30. The web 24 is thus sandwiched between the support fabric 32 and the forming fabric 22 to provide additional support to the web during operation of the air press 30. The air press 30 may be any conventional air press and therefore additional construction and operation of the air press is not provided herein. As an example, one suitable air press is disclosed in commonly assigned U.S. Pat. No. 6,306,257, issued Oct. 23, 2001 to Hada et al., which is incorporated herein by reference to the extent that it is consistent herewith.

The paper web 24 is then transferred from the forming fabric 22 to a transfer fabric 36 with the assistance of another vacuum device 37, the construction and operation of which is described later herein. Suitable transfer fabrics are those paper making fabrics which provide a high fiber support index and provide a good vacuum seal to maximize transfer fabric/web contact during transfer from the forming fabric. The transfer fabric 36 can have a relatively smooth surface contour to impart smoothness to the web 24, yet desirably has enough texture to grab the web and maintain contact during the transfer operation. Finer fabrics can produce a higher degree of stretch in the web, which is desirable for some product applications.

Transfer fabrics 36 include single-layer, multi-layer, or composite permeable structures as are known in the art. As an example, suitable transfer fabrics are available from Asten Forming Fabrics, Inc. of Appleton, Wis. Other examples of transfer fabrics that may be used also include the fabrics disclosed in commonly assigned U.S. Pat. No. 5,429,686 issued Jul. 4, 1995, to Chiu et al., which is incorporated herein by reference. Suitable transfer fabrics may comprise woven fabrics, nonwoven fabrics, or non-woven-woven composites. The void volume of the transfer fabric 36 can be equal to or less than the forming fabric from which the web 24 is transferred. The transfer fabric may also have raised areas or knuckles to impart a pattern to the web 24 supported by the fabric.

The transfer fabric 36 transports the paper web 24 over rolls 38 and 39 and then the web is transferred to a throughdrying fabric 40 with the assistance of yet another vacuum device 42, which may be substantially the same as the vacuum device 37 and vacuum devices 28. The web 24 is carried by the throughdrying fabric 40 over a throughdryer 44 to dry the paper web to a desired final dryness. Prior to being wound onto a reel 48 for subsequent conversion into the final product form, the paper web 24 can be carried through one or more optional fixed gap fabric nips formed between carrier fabrics 52 and 53. The bulk, or caliper of the paper web 24 can be controlled by fabric embossing nips formed between rolls 54 and 55, between rolls 56 and 57 and between rolls 58 and 59. Alternatively, a reel calendar can be employed to achieve final caliper or complement off-line calendering.

With the exception of the vacuum devices 28, 37 and 42, the paper making apparatus described heretofore is generally conventional and known to those skilled in the art. For example, one such apparatus is disclosed in U.S. Pat. No. 6,306,257, issued Oct. 23, 2001 to Hada et al., the entire disclosure of which is incorporated herein by reference to the extent that it is consistent herewith.

Figure 2:
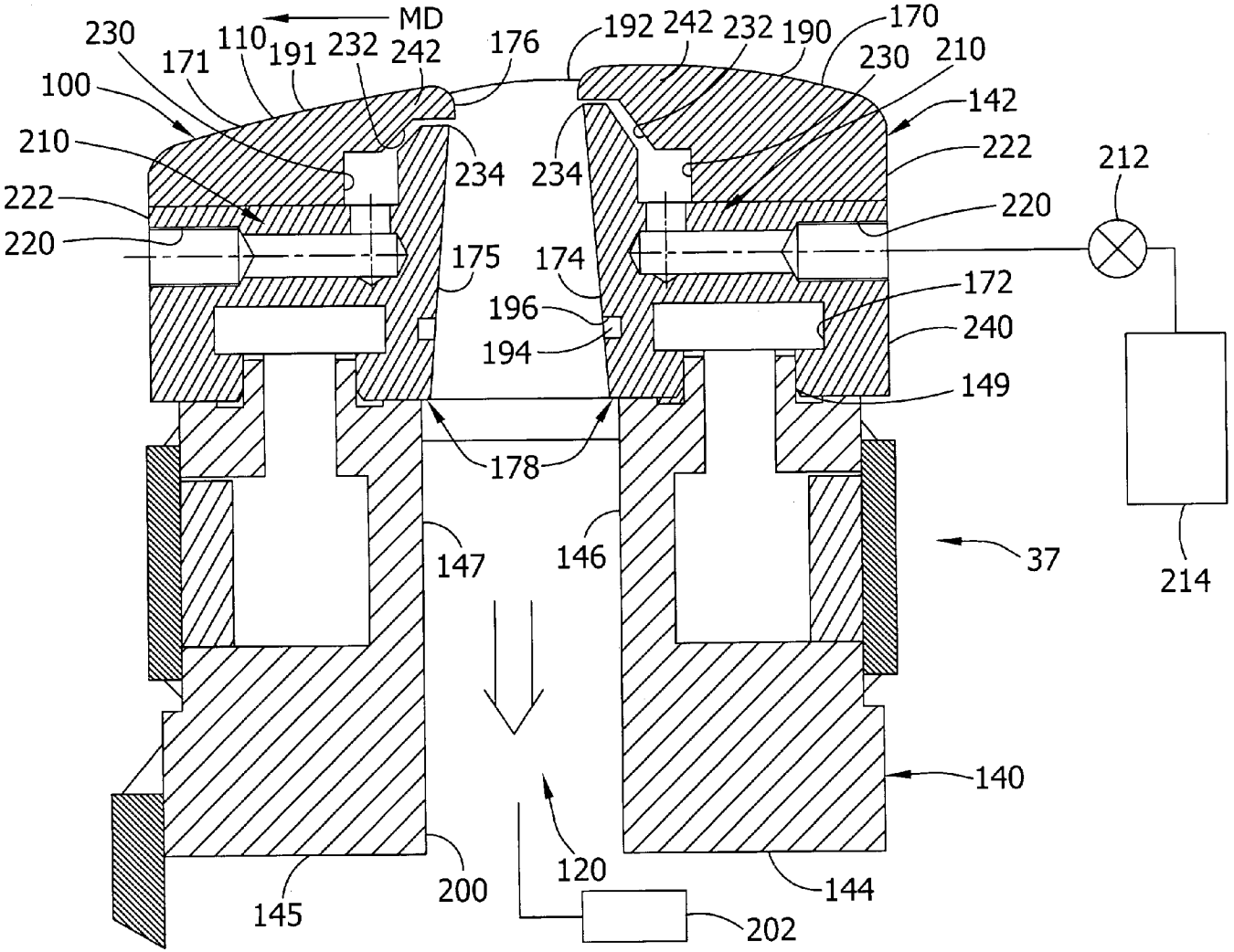
FIG. 2 is a cross sectional view of a vacuum device of the apparatus of FIG. 1.
Figure 3:
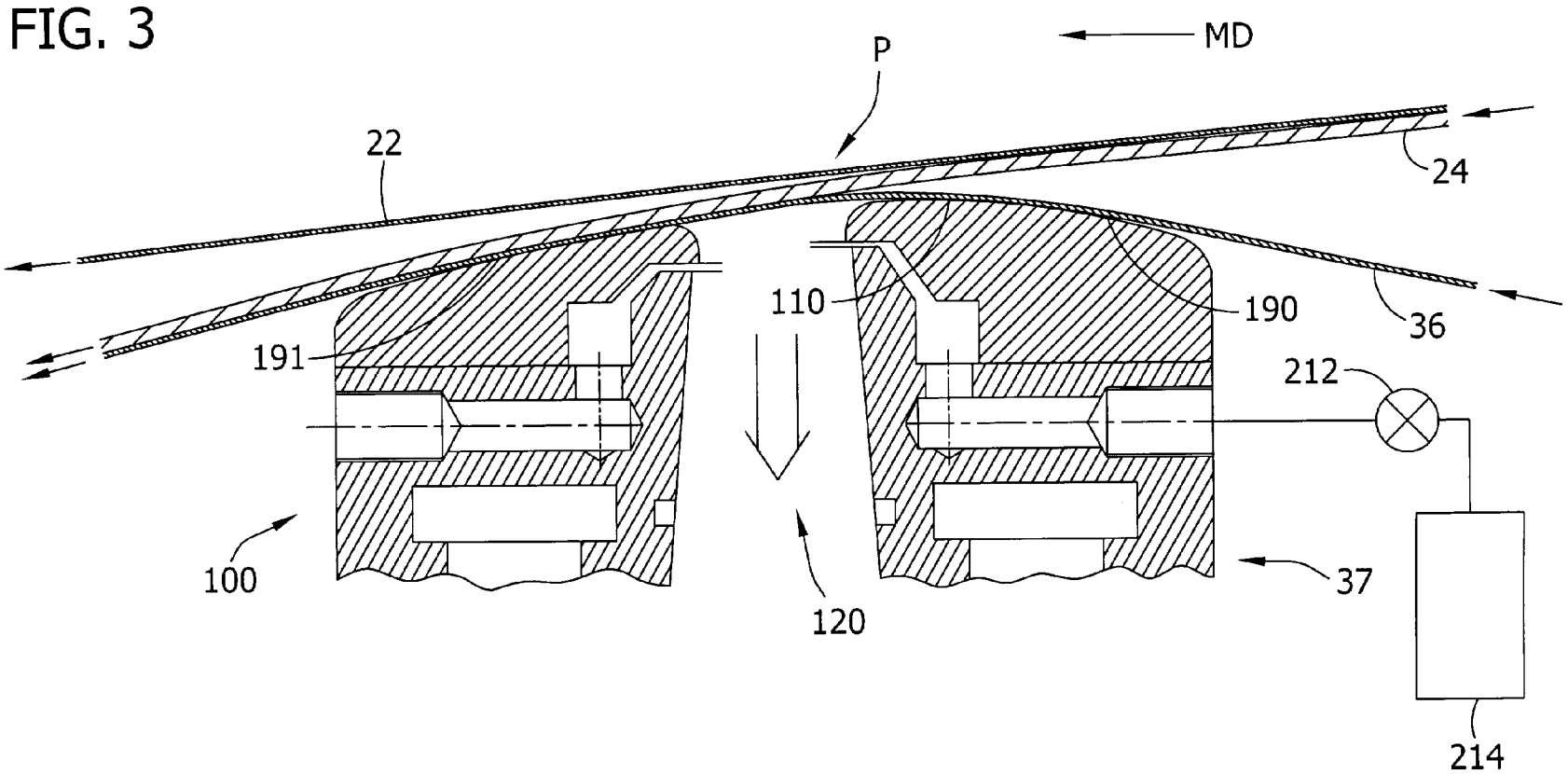
FIG. 3 is a fragmented cross section of the vacuum device of FIG. 2 illustrating the transfer of a paper web from a first to a second fabric at the vacuum device.

With particular reference now to FIGS. 2 and 3, construction and operation of the vacuum device 37 used to transfer the paper web 24 from the forming fabric 22 to the transfer fabric 36 will now be described. The vacuum device 37 generally comprises a housing, generally indicated at 100, having a web-facing surface 110 and a vacuum channel, generally indicated at 120, open at the web-facing surface 110 and extending interior of the housing 100. The housing 100 is generally elongate and extends laterally, e.g., in the cross-machine direction (e.g., into the page in FIGS. 2 and 3), relative to the machine direction MD movement of the forming fabric 22 and paper web 24 past the vacuum device 37 as shown in FIG. 3. More particularly, the housing 100 is desirably at least as long as the width of the forming fabric 22. For example, in one embodiment, the housing 100 has a length in the range of about 100 to about 300 inches (about 2.54 m to about 7.62 m), and more desirably in the range of about 125 to about 275 inches (about 3.175 m to about 6.985 m). However, it is understood that the length of the housing 100, and the width of the forming fabric 22, depends on the desired width of the final product to be manufactured, and thus can vary from apparatus to apparatus.

In the illustrated embodiment, the housing 100 is of two-piece construction including a body, generally indicated at 140, and a cover, generally indicated at 142, releasably mountable on the body 140 to define the web-facing surface 110 of the housing 100. However, it is understood that the body 140 and the cover 142 may be of unitary construction, or constructed of more than two pieces, without departing from the scope of this invention.

The body 140 has front and rear walls 144, 145 disposed in generally parallel, spaced relationship with each other so that opposed inner surfaces 146, 147 of the front and rear walls at least partially define the vacuum channel 120 within the housing 100. Desirably the inner surfaces 146, 147 of the front and rear walls 144, 145 are polished to inhibit fibrous material drawn into the vacuum channel 120 against sticking to the inner surfaces. Guide rails 149 are formed integrally with the top of each of the front and rear walls 144, 145 and extend longitudinally the length of the walls to facilitate positioning of the cover 142 on the body 140. A conventional fastening system (not shown) releasably mounts the cover 142 on the body 140.

The cover 142 also has front and rear walls 170, 171 each having a length substantially the same as that of the front and rear walls 144, 145 of the body 140. As shown in FIG. 2, the front and rear walls 170, 171 of the cover 142 are slightly wider than the walls 144, 145 of the body 140. However, it is understood that the cover walls 170, 171 may have the same width, or a narrower width, than the body walls 144, 145 without departing from the scope of this invention. The front wall 170 has a mounting channel 172 extending longitudinally therein and which is generally T-shaped in cross-section for use in releasably mounting the cover 142 on the body 140. The T-shaped channel 172 is sized to receive the guide rails 149 formed on the top of the front wall 144 of the body 140 therein in abutting relationship with the front wall 170 of the cover 142.

Still referring to FIG. 2, the front and rear walls 170 171 of the cover 142 are respectively mounted on the front and rear walls 144, 145 of the body 140 in spaced relationship with each other such that inner surfaces 174, 175 of the front and rear walls 170, 171 of the cover 142 further define the vacuum channel 120 within the housing 100 and also define a vacuum channel opening 176 at the top of the cover 142, e.g., at the web-facing surface 110 of the housing 100. Desirably, the inner surfaces 174, 175 of the front and rear walls of the cover 142 are polished to inhibit fibrous material drawn into the vacuum channel 120 against sticking to the inner surfaces. The inner surfaces 146, 147 of the front and rear walls of the body 140 and the inner surfaces 174, 175 of the front and rear walls 170, 171 of the cover 142 thereby together broadly define an inner wall, generally indicated at 178, of the vacuum channel 120.

In the illustrated embodiment, the inner surfaces 174, 175 of the front and rear walls 170, 171 of the cover 142 taper outward from the top of the cover 142 to the bottom thereof so that the vacuum channel 120 is narrower at the top of the vacuum device housing 100, e.g., at the vacuum channel opening 176, than at the bottom. As an example, the inner surfaces 174, 175 of the front and rear walls 170, 171 of the cover 142 desirably define an angle therebetween of less than about 10 degrees, and more particularly an angle of about 8.5 degrees. However, it is understood that the inner surfaces 174, 175 of the front and rear walls 170, 171 of the cover 142 may instead be straight, or they may be tapered inward from top to bottom, or they may be contoured. The spacing between the inner surfaces 174, 175 at the top of the cover 142 define the width of the vacuum channel opening 176 and is desirably in the range of about 0.25 inches to about 2 inches (about 6.35 mm to about 50.8 mm), and more desirably in the range of about 0.375 inches to about 1 inch (about 9.53 mm to about 25.4 mm). It is contemplated that the spacing between the inner surfaces 174, 175 of the front and rear walls 170, 171 of the cover 142 may be less than, or it may be greater than, the spacing between the inner surfaces 146,147 of the front and rear walls 144, 145 of the body 140 without departing from the scope of this invention.

The web-facing surface 110 at the top of the cover 142 comprises an approach, or leading edge surface 190 defined by the top of the front wall 170 of the cover 142 and a trailing edge surface 191 defined by the top of the rear wall 171 of the cover 142. In the illustrated embodiment, the front wall 170 of the cover 142 has a height greater than that of the rear wall 171 for reasons which will become apparent.

The housing 100 further comprises a pair of end panels 192 (one of which is shown in FIG. 2), each having a cross-sectional configuration matching the cross-section of the vacuum channel 120, which are supported by the cover 142 generally at the laterally opposite ends of the housing 100. The end panels 192 each have a pair of tabs 194 extending outward therefrom and sized for seating within corresponding grooves 196 formed in the inner surfaces 174, 175 of the front and rear walls 170, 171 of the cover 142 for supporting the end panels 192 in place. The end panels 192 are desirably selectively slidable in the grooves 196 to adjust the working length of the vacuum channel 120. That is, the vacuum channel 120 extends longitudinally between the end panels 192. For example, where the paper web 24 being formed has a width that is substantially less than the width of the supporting fabrics, the end panels 192 may be adjusted so that the working length of the vacuum channel 120 is substantially the same as the width of the paper web 24 being formed.

Still referring to FIG. 2, an inner end 200 of the vacuum channel 120 opposite the vacuum channel opening 176, e.g., at the bottom of the body 140 of the housing 100, is in fluid communication with a suitable vacuum source, which is shown schematically in the illustrated embodiment and indicated at 202. The vacuum source 202 may be any of a variety of apparatus well known in the art and capable of creating vacuum pressure. An example of one such vacuum source includes but is not limited to a conventional vacuum pump.

In accordance with the present invention, the vacuum device 37 further comprises a fluid delivery system, generally indicated at 210, for delivering a cleaning fluid into the vacuum channel 120 during operation of the vacuum to inhibit fibrous material against adhering to the vacuum channel wall 178 (e.g., the inner surfaces 146, 147, 174, 175 of the front and rear walls 144, 145, 170, 171 of the cover 142 and body 140). The cleaning fluid is desirably water, but may be generally any liquid, gas or fluent material capable of inhibiting the fibrous material against adhering to the vacuum channel wall. The fluid delivery system 210 generally comprises a delivery device, such as a pump (shown schematically in FIG. 2 and indicated at 212), in fluid communication with a source 214 of cleaning fluid for delivering cleaning fluid to the housing 100 of the vacuum device 37 via one or more hoses, tubes or other suitable fluid delivery conduits (not shown).

A plurality of inlet ports 220 (one of which is shown in FIG. 2), are formed in an outer surface 222 of the front wall 170 of the cover 142 in longitudinally spaced relationship with each other along the length of the cover 142. For example, in the illustrated embodiment the inlet ports 220 each have an inlet diameter of about 0.125 inches, and are longitudinally spaced from each other a distance of about 2 to about 5 inches (e.g. about 50.8 to 127 mm) and more particularly about three to about four inches (e.g., about 76.2 to about 101.6 mm) along the length of the cover 142. The inlet ports 220 are desirably adapted for connection with a respective one of the conduits leading from the delivery device 212 for receiving cleaning fluid into the front wall 170 of the cover 142 of the housing 100. For example, each of the inlet ports 220 may be internally threaded at their outer ends for threadable connection with one of the conduits. It is understood that instead of a plurality of inlet ports 220, a single elongate inlet slot (not shown) may be formed in and extend along all or part of the length of the front wall 170 of the cover 142, or a single inlet port may formed in the front wall of the cover 142, without departing from the scope of this invention.

The inlet ports 220 each extend into the front wall 170 of the cover 142 into fluid communication with a plenum 230 that extends longitudinally continuously along substantially the entire length of the wall 170. A fluid delivery channel 232 extends from the plenum 230 in fluid communication therewith to an exit slot 234 (broadly, an exit orifice) formed in the inner surface 174 of the front wall, e.g., in fluid communication with the vacuum channel 120. The slot 234 is desirably located generally adjacent the top of the cover 142 (e.g., adjacent the web-facing surface 110 of the housing 100), but sufficiently spaced therefrom to inhibit buckling of the cover 142 at the slot 234.

For example, in the illustrated embodiment the slot 234 formed in the inner surface 174 of the front wall of the cover 142 is desirably located in the range of about 3 to about 10 mm below the top of the cover 142, more desirably in the range of about 4 to about 8 mm, and even more desirably about 5 mm. However, it is understood that the slot 234 may be located generally anywhere along the vacuum channel wall 178, e.g., intermediate the vacuum channel opening 176 and the bottom 200 of the housing 100, without departing from the scope of this invention. As a further example, the height of the slot 234 shown in FIG. 2 is desirably in the range of about 0.4 mm to about 5 mm, more desirably in the range of about 0.4 to about 1.2 mm, and even more desirably in the range of about 0.5 to about 1.0 mm. However, the height of the slot 234 may vary depending on the amount and rate of delivery of the cleaning fluid to be delivered into the vacuum channel 120.

The slot 234 also desirably extends continuously substantially the length of the front wall 170 of the cover 142 (e.g., the length of the vacuum channel 120). However, it is contemplated that a plurality of discrete slots or orifices may be formed in the inner surface 174 of the front wall of the cover 142 in longitudinally spaced relationship with each other along the length of the wall. The slots or orifices may be aligned lengthwise in a straight line, or they may be disposed at different heights along the inner surface of the front wall of the cover 142. The fluid delivery channel 232 connecting the slot 234 with the plenum 230 also desirably extends continuously along the length of the front wall 170 of the cover 142. However, the fluid delivery system may instead comprise a plurality of discrete fluid delivery channels each in fluid communication at one end with the plenum 230 and in fluid communication at an opposite end with a respective discrete exit slot or orifice in the vacuum channel wall. Alternatively, it is also contemplated that the fluid delivery system may comprise a plurality of discrete delivery paths (e.g., including an inlet port, and exit orifice or slot, and a fluid delivery channel extending therebetween) for delivering cleaning fluid from the source 214 of cleaning fluid into the vacuum channel 120.

A similar set of inlet ports 220, plenum 230, fluid delivery channel 232 and exit slot 234 are formed in the rear wall 171 of the cover 142. Cleaning fluid may be delivered to the inlet ports 220 in the outer surface 222 of the cover 142 by the pump 212 and source 214 of cleaning fluid, or by a different pump (not shown) and/or from a different source (not shown) of cleaning fluid. Because the height of the rear wall 171 of the cover 142 is less then that of the front wall 170, the exit slot 234 formed in the inner surface 175 of the rear wall is lower than the exit slot 234 formed in the inner surface 174 of the front wall. However, it is understood that the exit slots 234 may be at substantially the same height, or they may be at different heights. It is also contemplated that the fluid delivery system 210 may comprise delivering cleaning fluid into the vacuum channel 120 via only one of the front and back walls 170, 171 of the cover 142 (instead of both), or the cleaning fluid may be delivered into the vacuum channel 120 via the front and/or back walls 144, 145 of the body 140 without departing from the scope of this invention.

In the illustrated embodiment, the front wall 170 of the cover 142 is of two-piece construction including a base 240, with the T-shaped mounting channel 172 formed in the bottom of the base 240 and the inlet ports 220 formed in the outer surface 222 thereof. A lip 242 is secured to the base 240 by suitable fasteners (not shown) spaced longitudinally along the length of the cover 142, and is shaped so that the lip 242 and base 240 together define the plenum 230, fluid delivery channel 232 and exit slot 234 when fastened together. In the illustrated embodiment, the lip 242 of the front wall of the cover 142 extends into the vacuum channel 120 at the exit slot 234 slightly inward the base 240 of the front wall to inhibit fluid exiting the exit slot 234 against flowing out through the vacuum channel opening 176 toward the paper web 24 as the web passes over the vacuum channel 120. The rear wall 171 of the cover 142 is constructed in substantially the same manner.

In operation as illustrated in FIG. 3, the transfer fabric 36 is moved in the machine direction MD over the web-facing surface 110 of the vacuum device housing 100. The transfer fabric 36 is desirably maintained taut so that it moves first over the leading edge surface 190 in contact therewith, then spans the vacuum channel opening 176 and moves over the trailing edge surface 191 in contact therewith. As the forming fabric 22 approaches the vacuum device 37, the paper web 24 is on the side of the forming fabric 22 that faces the transfer fabric 36 and web-facing surface 110 of the vacuum device housing 100. The spacing between the transfer fabric 36 and the forming fabric 22 substantially narrows as the forming fabric 22 approaches the vacuum device 37, and more particularly the fabrics 22, 36 desirably converge at a point "P" generally toward the leading edge surface 190 side of the vacuum channel opening 176.

As the converged fabrics 22, 36 pass over the vacuum channel opening 176, the vacuum generated by the vacuum source 202 draws a vacuum on the paper web 24, e.g., by drawing air into the vacuum channel opening 176 and through the vacuum channel 120 in a flow direction indicated by the double arrow shown in FIGS. 2 and 3. The vacuum applied to the paper web 24 pulls the web away from the forming fabric 22 and draws the web against the transfer fabric 36. As an example, the vacuum force to effect the transfer can be from about 3 to about 25 inches of mercury (7.6 cm–63.5 cm Hg), and preferably about 5 inches of mercury (12.7 cm Hg). As the fabrics 22, 36 move downstream of the vacuum channel opening 176, the fabrics 22, 36 diverge from each other, leaving the paper web 24 supported by on the transfer fabric 36 for movement downstream of the vacuum device 37 in the machine direction MD.

During operation of the paper making apparatus 10, e.g., during movement of the fabrics 22, 36 and paper web 24 over the web-facing surface 110 of the vacuum device housing 100 and during operation of the vacuum to transfer the paper web 24 onto the transfer fabric 36, the fluid delivery system 210 is operable to deliver cleaning fluid into the vacuum channel 120. More particularly, the cleaning fluid is delivered from the source 214 of cleaning fluid, such as by the pump 212, into the front and rear walls 170, 171 of the cover 142 via the inlet ports 220 formed therein. The cleaning fluid then flows into the plenums 230, through the fluid delivery channels 232 and to the exit slots 234 formed in the inner surface 174, 175 of the front and rear walls of the cover 142 for delivery into the vacuum channel 120. The cleaning fluid becomes entrained in the airflow in the vacuum channel 120 and moistens or otherwise coats the wall 178 of the vacuum channel 120 to inhibit fibrous material against adhering to the vacuum channel wall.

The cleaning fluid is desirably delivered to the vacuum channel 120 at a relatively slow rate, e.g., below that which would result in a jetting of the cleaning fluid into the vacuum channel 120, to allow sufficient entrainment of the cleaning fluid in the airflow generated by the vacuum within the vacuum channel 120. For example, in one embodiment the fluid pressure in the fluid delivery system is desirably in the range of about 1 psi ($6.895\times10^4$ dyne/cm$^2$) to about 50 psi ($344.75\times10^4$ dyne/cm$^2$), and more desirably in the range of about 4 psi ($27.58\times10^4$ dyne/cm$^2$) to about 10 psi ($68.95\times10^4$ dyne/cm$^2$). It is understood that the flow rate of the cleaning fluid into the vacuum channel may vary depending on the fluid pressure, the size of the vacuum channel 120 and the strength of the vacuum within the vacuum channel 120.

As various changes could be made in the above constructions and methods, without departing from the scope of the invention, it is intended that all matter contained in the above description and shown in the accompanying drawings shall be interpreted as illustrative and not in a limiting sense.

When introducing elements of the invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A vacuum device for a paper web making apparatus, said apparatus being adapted to transport a paper web in a machine direction past the vacuum device, said vacuum device comprising:

a housing having an outer web-facing surface and an elongate vacuum channel extending within the housing and having a longitudinal direction and an opening at said web-facing surface;

a vacuum source in fluid communication with the vacuum channel and being operable to draw a vacuum on the paper web via the vacuum channel opening; and a fluid delivery system configured to deliver cleaning liquid into the vacuum channel generally transverse to the longitudinal direction thereof, said fluid delivery system comprising at least in part a liquid delivery device operable to deliver the cleaning liquid into the vacuum channel, the vacuum source being operable during the delivery of cleaning liquid into said vacuum channel.

2. A vacuum device as set forth in claim 1 wherein the fluid delivery system comprises at least one orifice in the housing in fluid communication with the vacuum channel, said at least one orifice being in fluid communication with a source of cleaning liquid, said liquid delivery device being operable to deliver cleaning liquid from the source of cleaning liquid to the orifice for delivery into the vacuum channel.

3. A vacuum device as set forth in claim 2 wherein the vacuum source is operable to draw air into the vacuum channel via the vacuum channel opening and to direct the air to flow through the vacuum channel in a flow direction, said at least one orifice being disposed generally adjacent the vacuum channel opening downstream therefrom in the vacuum flow direction.

4. A vacuum device as set forth in claim 3 wherein the vacuum source is operable to draw air into the vacuum channel via the vacuum channel opening and to direct the air to flow through the vacuum channel in a flow direction, said at least one orifice being disposed downstream of the vacuum channel opening in the direction of vacuum flow a distance of about 3 mm to about 10 mm.

5. A vacuum device as set forth in claim 2 wherein the fluid delivery system further comprises at least one inlet port formed in the housing and in fluid communication with the source of cleaning liquid for receiving cleaning liquid into the housing, the at least one orifice being in fluid communication with the at least one inlet port to provide fluid communication between the at least one orifice and the source of cleaning liquid.

6. A vacuum device as set forth in claim 1 wherein the vacuum channel has a length, said at least one orifice comprising at least one slot formed in the vacuum channel wall and extending continuously along at least a portion of the length of the vacuum channel.

7. A vacuum device as set forth in claim 6 wherein the at least one slot extends continuously along substantially the full length of the vacuum channel.

8. A vacuum device as set forth in claim 6 wherein the at least one slot has a height in the range of about 0.4 to about 1.2 mm.

9. A vacuum device as set forth in claim 8 wherein the at least one slot has a height of about 0.8 mm.

10. A vacuum device as set forth in claim 1 wherein the housing has opposed inner surfaces therein at least partially defining the vacuum channel, said at least one orifice comprising at least one orifice formed in one of said inner surfaces and at least one other orifice formed in the opposed inner surface.

11. A vacuum device as set forth in claim 1 wherein the housing comprises a base and a cover mounted on the base, said vacuum channel extending at least within the cover of the housing.

12. A vacuum device as set forth in claim 11 wherein the cover is releasably mounted on the base.

13. A vacuum device as set forth in claim 1 wherein the liquid delivery device is operable to deliver cleaning liquid into the vacuum channel during operation of the apparatus to transport the paper web past the vacuum device.

14. A vacuum device as set forth in claim 1 further comprising a source of cleaning liquid in fluid communication with the fluid delivery system wherein said fluid delivery system is configured to deliver cleaning liquid from said source of cleaning liquid into the vacuum channel.

15. A vacuum device as set forth in claim 1 wherein said liquid delivery device is a liquid pump.

16. A vacuum device for a paper web making apparatus, said vacuum device comprising:

a housing having an outer web-facing surface and an elongate vacuum channel extending within the housing and having a longitudinal direction and an opening at said web-facing surface;

a vacuum source in fluid communication with the vacuum channel for drawing air into the vacuum channel via the vacuum channel opening at the web-facing surface of the housing and for directing the air to flow through the vacuum channel in a vacuum flow direction; and a fluid delivery system configured to deliver cleaning liquid into the vacuum channel in a fluid delivery direction at least partially different from the vacuum flow direction and at least partially different from the longitudinal direction of the vacuum channel, said fluid delivery system comprising at least in part a liquid delivery device operable to deliver the cleaning liquid into the vacuum channel.

17. A vacuum device as set forth in claim 16 wherein the fluid delivery system comprises at least one orifice in the housing in fluid communication with the vacuum channel, said at least one orifice being in fluid communication with a source of cleaning liquid, said liquid delivery device being operable to deliver cleaning liquid from the source of cleaning liquid to the orifice for delivery into the vacuum channel.

18. A vacuum device as set forth in claim 17 wherein the orifice is configured to deliver cleaning liquid to the vacuum channel in a fluid delivery direction that is generally normal to the vacuum flow direction.

19. A vacuum device for a paper web making apparatus, said vacuum device comprising:

a housing having an outer web-facing surface and an inner channel wall defining an elongate vacuum channel extending within the housing, said inner channel wall having an outer end at the web facing surface and an inner end, the vacuum channel having an opening at the web-facing surface, said inner channel wall being at least in part defined by opposed elongate inner surfaces;

a vacuum source in fluid communication with the vacuum channel and operable to draw air into the vacuum channel via the vacuum channel opening at the web-facing surface of the housing and directing the air to flow through the vacuum channel in a vacuum flow direction;

a fluid delivery system configured to deliver cleaning liquid into the vacuum channel, said fluid delivery system comprising at least one orifice in at least one of the inner surfaces of the channel wall intermediate the outer and inner ends thereof; and a source of cleaning liquid in fluid communication with said orifice whereby cleaning liquid is delivered from said source of cleaning liquid by said fluid delivery system into the vacuum channel via said at least one orifice.

20. A vacuum device as set forth in claim 19 wherein the at least one orifice is located in the channel wall generally adjacent the outer end thereof.

21. A vacuum device as set forth in claim 19 wherein the at least one orifice is located in the vacuum channel wall in the range of about 3 mm to about 10 mm from the outer end thereof.

22. A vacuum device as set forth in claim 21 wherein the at least one orifice is located in the vacuum channel wall in the range of about 4 mm to about 8 mm from the outer end thereof.

23. A vacuum device as set forth in claim 19 wherein the fluid delivery system further comprises at least one inlet port formed in the housing and in fluid communication with the source of cleaning liquid for receiving cleaning liquid into the housing, the at least one orifice being in fluid communication with the at least one inlet port to provide fluid communication between the at least one orifice and the source of cleaning liquid.

24. A vacuum device as set forth in claim 19 wherein the vacuum channel wall has a length, said at least one orifice comprising at least one slot formed in the at least one inner surface of the vacuum channel wall and extending continuously along at least a portion of the length of the vacuum channel wall.

25. A vacuum device as set forth in claim 24 wherein the at least one slot extends continuously along substantially the full length of the vacuum channel wall.

26. A vacuum device as set forth in claim 24 wherein the at least one slot comprises a pair of slots formed in the at least one inner surface of the vacuum channel wall.

27. A vacuum device as set forth in claim 24 wherein the at least one slot has a height in the range of about 0.4 to about 1.2 mm.

28. A vacuum device as set forth in claim 27 wherein the at least one slot has a height of about 0.8 mm.

29. A vacuum device as set forth in claim 19 wherein said at least one orifice comprises at least one orifice formed in one of said inner surfaces and at least one other orifice formed in the opposed inner surface.

30. A vacuum device as set forth in claim 19 wherein the housing comprises a base and a cover mounted on the base, said vacuum channel extending at least within the cover of the housing.

31. A vacuum device as set forth in claim 30 wherein the cover is releasably mounted on the base.

32. Apparatus for making a paper web, said apparatus comprising:

at least one endless fabric supporting the paper web, said endless fabric being moveable in a machine direction of the apparatus to transport the paper web in said machine direction; and a vacuum device comprising:

a housing having a web-facing surface whereby the paper web supported by the fabric is transported past the web-facing surface of the vacuum device upon movement of the fabric in the machine direction, and an elongate vacuum channel extending within the housing and having a longitudinal direction and an opening at said web-facing surface;

a vacuum source in fluid communication with the vacuum channel and being operable to draw a vacuum on the paper web via the vacuum channel opening;

a fluid delivery system configured to deliver cleaning liquid into the vacuum channel generally transverse to the longitudinal direction thereof during operation of the vacuum source; and a source of cleaning liquid in fluid communication with the fluid delivery system whereby cleaning liquid is delivered from said source of cleaning liquid into the vacuum channel via the fluid delivery system.

33. Apparatus as set forth in claim 32 wherein the fabric is a first fabric, said apparatus further comprising a second endless fabric moveable in the machine direction past the vacuum device in opposed relationship with the web-facing surface of the vacuum device housing intermediate the web-facing surface and the first fabric, the first fabric being adapted for supporting the paper web in opposed relationship with the second fabric as the first and second fabrics move past the vacuum device, the vacuum source being operable to draw a vacuum on the paper web to transfer the paper web from the first fabric to the second fabric so that the second fabric supports the paper web upon movement of the second fabric in the machine direction downstream of the vacuum device.

34. Apparatus as set forth in claim 32 wherein the fluid delivery system comprises at least one orifice in the housing in fluid communication with the vacuum channel, said at least one orifice being in fluid communication with the source of cleaning liquid, said fluid delivery system being configured to deliver cleaning liquid from the source of cleaning liquid to the orifice for delivery into the vacuum channel.

35. Apparatus as set forth in claim 34 wherein the fluid delivery system further comprises at least one inlet port formed in the housing and in fluid communication with the source of cleaning liquid for receiving cleaning liquid into the housing, the at least one orifice being in fluid communication with the at least one inlet port to provide fluid communication between the at least one orifice and the source of cleaning liquid.

36. Apparatus as set forth in claim 32 wherein the vacuum source is operable to draw air into the vacuum channel via the vacuum channel opening and to direct the air to flow through the vacuum channel in a flow direction, said at least one orifice being disposed generally adjacent the vacuum channel opening downstream therefrom in the vacuum flow direction.

37. Apparatus as set forth in claim 32 wherein the fluid delivery system is configured to deliver cleaning liquid to the vacuum channel in a fluid delivery direction at least partially different from the vacuum flow direction.

38. Apparatus as set forth in claim 37 wherein the fluid delivery system is configured to deliver cleaning liquid to the vacuum channel in a fluid delivery direction that is generally normal to the vacuum flow direction.

39. A vacuum device for a paper web making apparatus, said apparatus being adapted to transport a paper web in a machine direction past the vacuum device, said vacuum device comprising:

a housing having an outer web-facing surface and an elongate vacuum channel extending within the housing and having a longitudinal direction and an opening at said web-facing surface;

a vacuum source in fluid communication with the vacuum channel and being operable to draw a vacuum on the paper web via the vacuum channel opening; and a fluid delivery system configured to deliver cleaning liquid into the vacuum channel generally transverse to the longitudinal direction thereof, said fluid delivery system comprising at least one orifice in the housing in fluid communication with the vacuum channel for delivering cleaning liquid into the vacuum chamber, said at least one orifice being disposed downstream of the vacuum channel opening in the vacuum flow direction at a location at which the vacuum channel extends downstream from said at least one orifice a distance greater than a distance between the vacuum channel opening and said at least one orifice, the vacuum source being operable during the delivery of cleaning liquid into said vacuum channel.

40. A vacuum device for a paper web making apparatus, said apparatus being adapted to transport a paper web in a machine direction past the vacuum device, said vacuum device comprising:

a housing having an outer web-facing surface and an elongate vacuum channel extending within the housing and having a longitudinal direction and an opening at said web-facing surface, the vacuum channel being defined at least in part by opposing walls;

a vacuum source in fluid communication with the vacuum channel and being operable to draw a vacuum on the paper web via the vacuum channel opening; and a fluid delivery system configured to deliver cleaning liquid into the vacuum channel generally transverse to the longitudinal direction thereof, said fluid delivery system comprising at least one orifice in each of the opposing walls in fluid communication with the vacuum channel, said at least one orifice being in fluid communication with a source of cleaning liquid, said fluid delivery system being configured to deliver cleaning liquid from the source of cleaning liquid to said at least one orifice for delivery into the vacuum channel, said vacuum source being operable during the delivery of cleaning liquid into said vacuum channel.

* * * * *